United States Patent [19]

Cotgreave et al.

[11] 4,394,931

[45] Jul. 26, 1983

[54] HEAT-INSULATED CONTAINER PROVIDED WITH A LOCATING AND/OR SUPPORTING DEVICE

[75] Inventors: Terence Cotgreave, Deeside, Wales; David A. Cliffe, Middleton, England

[73] Assignee: Shell Internationale Research Maatschappij B. V., The Hague, Netherlands

[21] Appl. No.: 258,028

[22] Filed: Apr. 27, 1981

[30] Foreign Application Priority Data

Apr. 25, 1980 [GB] United Kingdom ..... 8013743

[51] Int. Cl.[3] ..... B65D 25/02; B65D 90/04; B65D 25/10

[52] U.S. Cl. ..... 220/453; 114/74 A; 220/1 B; 220/901; 220/902

[58] Field of Search ..... 220/1 B, 453, 468, 901, 220/902; 52/245, 246; 62/45; 114/74 A

[56] References Cited

U.S. PATENT DOCUMENTS

| | | | |
|---|---|---|---|
| 2,346,129 | 4/1944 | DeVore | 220/1 B X |
| 3,112,049 | 11/1963 | Messer | 114/74 A |
| 3,337,079 | 8/1967 | Clarke et al. | 114/74 A X |
| 3,521,416 | 7/1970 | Joor | 220/1 B X |
| 3,859,805 | 1/1975 | Johnson et al. | 62/45 |
| 3,968,764 | 7/1976 | Kuamsdal | 114/74 A |
| 3,974,935 | 8/1976 | Ffooks | 220/901 X |
| 4,170,952 | 10/1979 | McCown | 114/74 A |

FOREIGN PATENT DOCUMENTS

| | | |
|---|---|---|
| 1453297 | 10/1976 | United Kingdom . |
| 1516150 | 6/1978 | United Kingdom . |

*Primary Examiner*—Allan N. Shoap

*Attorney, Agent, or Firm*—Pravel, Gambrell, Hewitt, Kirk & Kimball

[57] ABSTRACT

A heat-insulated container for liquefied gases, which includes a rigid outer shell internally lined with a heat-insulating material, is provided with a locating and/or supporting device for pumps or other apparatus. The support device is formed of a material having a low coefficient of thermal expansion, such as an iron-nickel alloy and is bonded directly or indirectly to the heat-insulating material lining the rigid shell.

13 Claims, 3 Drawing Figures

A
15
21
6
19
20
18
17
16
22
5
13
14
2
3

HEAT-INSULATED CONTAINER PROVIDED WITH A LOCATING AND/OR SUPPORTING DEVICE

The invention relates to a heat-insulated container for liquefied gases, comprising a rigid outer shell internally lined with a heat-insulating material.

A container of this kind is, for example, described in the patent specification pertaining to applicant's British patent No. 1,453,297, which was published on Oct. 20, 1976. Such containers are normally not provided with a so-called inner tank for containing the liquefied gas, so that the locating and/or supporting of apparatus and structures within the container, such as, for example, pumps, tower structures, antisloshing baffles and guy-wires, creates problems.

It is an object of the invention to provide a heat-insulated container of the above kind with a locating and/or supporting device of a special design, so that apparatus and structures can be located and/or supported within the container in a safe and efficient manner.

For this purpose, a heat-insulated container for liquefied gases, comprising a rigid outer shell internally lined with a heat-insulating material is provided, according to the invention, with a locating and/or supporting device which comprises a plate made of a material having a low coefficient of thermal expansion and bonded to the inner side of the heat-insulating material lining the rigid outer shell, said plate being provided with means for securing or locating a structure or apparatus to, or relative to, the plate.

In an attractive embodiment of the invention, the plate is made of an iron-nickel alloy having a small coefficient of thermal expansion, such as for example invar.

In a suitable embodiment of the invention, the means for securing or locating a structure or apparatus to, or relative to, the plate is an extension on the inner side of the plate, for example a cylinder secured with one end to the inner side of the plate.

The plate is preferably bonded to the heat-insulating material, which is preferably rigid polyurethane foam, by means of an epoxy resin formulation containing a reinforcement material, such as for example milled glass fibre-material.

The invention will be explained with reference to the drawings, wherein.

Figure 1:
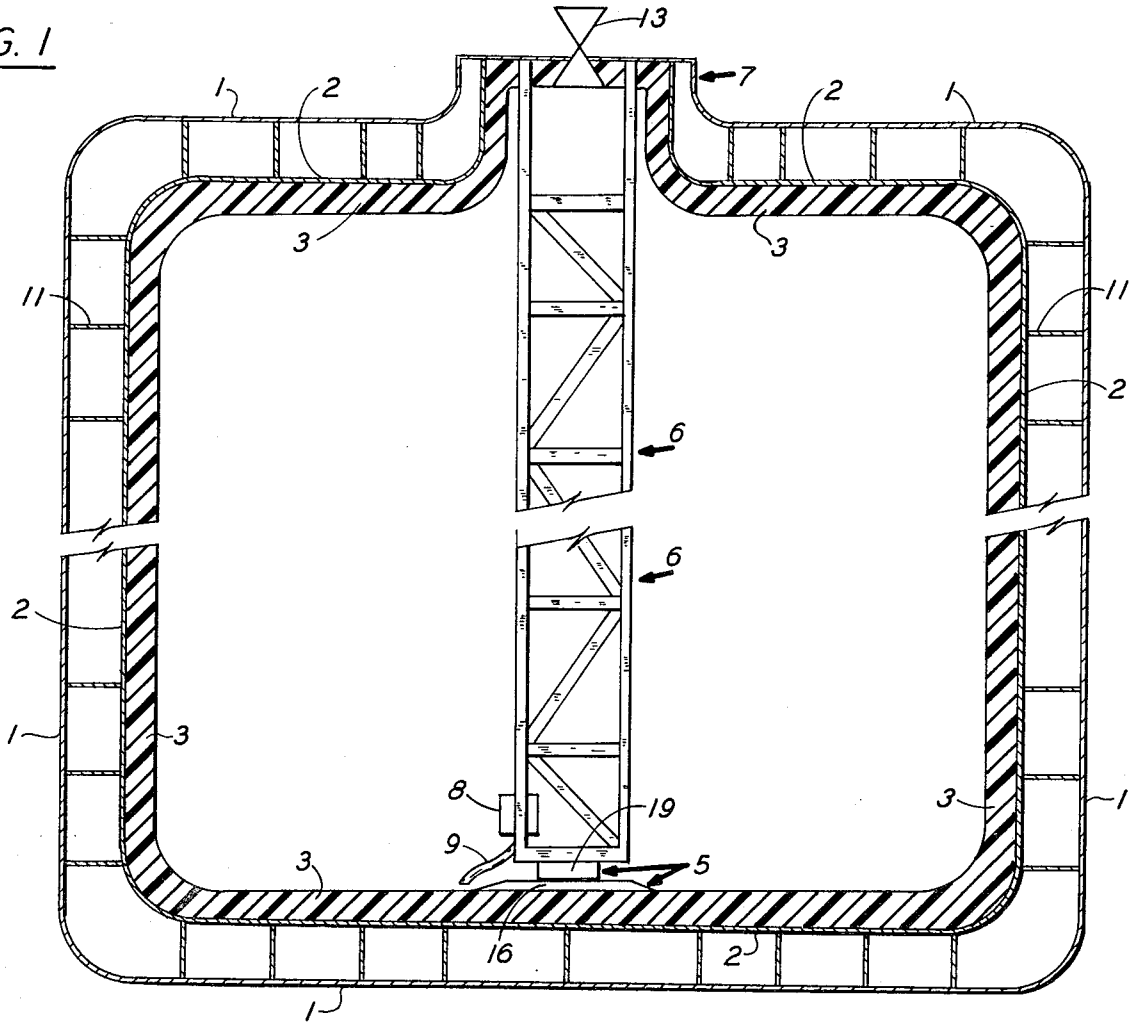
FIG. 1 shows schematically a vertical cross-section of a heat-insulated container, provided with a tower structure incorporating a locating and/or supporting device according to the invention.

In FIG. 1 the steel outer hull of a ship for transporting a liquefied gas is indicated by the reference numeral 1, whereas the steel inner hull of the ship is indicated by the reference numeral 2. The inner hull 2, which is connected to the outer hull 1 in conventional manner, such as with rib members 11 welded or otherwise connected between hull 1 and hull 2, forms the rigid outer shell of a container for a liquefied gas cargo. The said rigid outer shell 2 is internally lined with heat-insulating material 3, which is preferably rigid polyurethane foam. The top of the container is provided with a heat-insulated dome 7, wherein access to the container is provided through valve 13 or the like.

Within the container a tower structure 6 is present, which is suspended from the dome 7 and extends from the roof of the container towards the bottom of the container. The lower part of the tower structure 6 is located by the locating and/or supporting device 5 according to the invention.

The tower structure 6 carries pump and pipelines for loading and unloading the tank; one such pump 8 with its suction line 9 being shown in FIG. 1.

By means of the locating and/or supporting device 5, the lower part of the tower structure 6 is located relative to the layer of heat-insulating material 3 on the bottom wall of the tank.

The locating and/or supporting device 5 will be described in detail with reference to FIG. 2.

The inner surface of the layer of polyurethane foam 3, which is, in this embodiment, the top surface 13 of the layer of polyurethane foam on the bottom of the rigid outer shell 2, is preferably provided with a laminate 14 comprising a ply of glass-cloth and a cured epoxy resin formulation. The purpose of the laminate 14 is to prevent the formation of cracks in the polyurethane foam 3 adjacent to the top surface 13. The presence of the laminate 14 is necessary when liquefied gases are stored in the container at very low temperatures, such as, for example, liquefied natural gas. The laminate 14 can, however, be omitted when liquefied gases are stored at less extreme temperatures, such as for example liquefied propane.

A flat plate 16, for example made of invar, which preferably has the shape of a disc, is bonded to the laminate 14 (or if no laminate 14 is present the plate 16 is bonded to the top surface 13 of the layer of polyurethane foam 3) by a gap filling crack-resistant adhesive 18, such as an epoxy mastic, preferably reinforced by a suitable reinforcement material, such as for example milled glass fibre.

The mastic comprises an epoxy resin, which may contain a flexibilizer or a diluent and milled glass fibre in an amount of 5 to 20 percent by volume of the cured composite, wherein the glass fibres have an average length in the range of 0.2 mm to 1.0 mm.

In addition a thixotropic or viscosity modifying agent may be included, for example Aerosil, in the ratio of 1 to 8 parts by weight per 100 parts by weight of resin. Furthermore, a surfactant may be included, and/or other additives, for example Borchigol, in the ratio of 1 to 2 parts by weight per 100 parts by weight of resin.

The curing agent may be amine-based, a preferred curing agent being a modified cycloaliphatic amine, and can be used in an amount of for example 25 to 35 parts by weight per 100 parts by weight of resin. Additionally, the curing agent may contain a thixotropic or viscosity-modifying agent.

Pigments, dyes and fillers may be included in the resin mixture and in the curing agent, if desired.

As an example, a mastic which may be used to bond the plate 16 to the inner surface of the laminate 14 or, if no laminate 14 is present, to bond the plate 16 directly to the inner surface 13 of the layer of polyurethane foam 3, comprises:

| | |
|---|---|
| Epoxy resin: | EPIKOTE 828 |

-continued

| | | |
|---|---|---|
| Flexibilizer: | EPOXIDE 151 | 100 g |
| Reinforcement material: | 0.2 mm milled glass fibre: 34 g | |
| Thixotropic agent: | Aerosil: 4 g | |
| Additive: | Borchigol: 1 g | |
| Curing agent: | A modified cycloaliphatic amine: 31 g. | |

EPIKOTE 828 is a glycidyl polyether of 2,2-bis(4-hydroxyphenyl)propane having an epoxy equivalent weight of 182–194 and a viscosity of 100–150 poises at 25° C. EPIKOTE is a registered trade mark.

EPOXIDE 151 is a flexibilizing epoxy resin.

Borchigol is an additive manufactured by "Gebrüder Borchers A.G.", Düsseldorf, Germany.

Figures 2, 3:
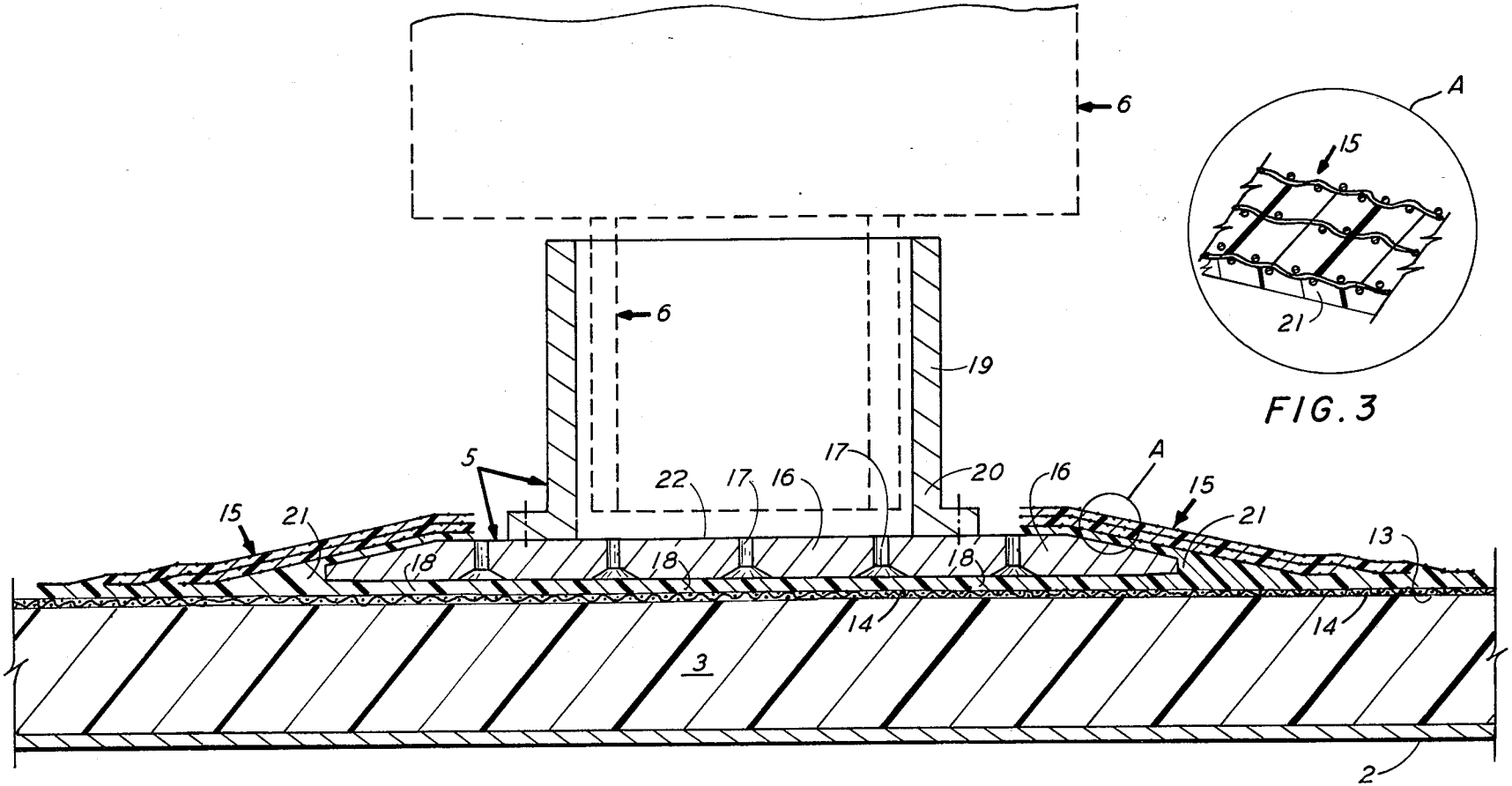
FIG. 2 shows schematically in detail a vertical cross-section of the locating and/or supporting device according to the invention .
FIG. 3 is an enlargement in cross section of that portion of the base of a heat-insulated container of the present invention as is shown in circle A in FIG. 2.

The plate 16 is tapered along its periphery as shown in FIG. 2 and is provided with vertical openings 17, which act as vent holes.

In order to bond the plate 16 to the polyurethane foam 3, a certain quantity of the above-mentioned epoxy mastic 18 is spread on top of the laminate 14 (or if no laminate 14 is present, the said epoxy mastic is spread on the top surface 13 of the layer of polyurethane foam 3) covering the attachment area. Then the plate 16 is lowered into the mastic at an oblique angle, so that the mastic/plate interface develops smoothly allowing air to escape ahead of the contact front.

When the plate 16 has reached a horizontal position, firm vertical pressure is applied to the plate 16 to expel excess air and mastic from the vent holes 17 and the permieter of the plate 16. Then a glass-cloth collar 15 comprising for example three plies of glass-cloth on top of each other, is secured by means of an epoxy resin formulation to the top surface of the plate 16 and to the top surface of the laminate 14 (or if no laminate 14 is present to the top surface 13) as shown. Finally, the epoxy resin formulation 18 below the plate 16 and of the collar 15 is allowed to cure so that a good bond is obtained.

Before the application of the collar 15 a fillet 21 of the above-mentioned epoxy mastic may be applied at the rim of the plate 16, to prevent the formation of voids at the location where the collar 15 passes from the plate 16 to the laminate 14 (or if no laminate 14 is present, to the top surface 13).

The inner- or top side 22 of the plate 16 is provided with an extension, which in the embodiment according to FIG. 2 is a vertical cylinder 19. The lower end of the cylinder 19 is provided with a radial flange 20, for bolting or welding the cylinder 19 to the plate 16.

In use, the lower part of the tower structure 6 according to FIG. 1 is located within the cylinder 19. The lower part of the tower structure 6 is indicated schematically in FIG. 2 by dotted lines. It will be clear that the cylinder 19 will effectively prevent lateral movement of the structure 6, while leaving the structure 6 free to expand and contract in a vertical direction.

The locating and/or supporting device according to the invention can be used for locating apparatus or structures, but it can be used as well, or instead, for supporting apparatus or structures. Furthermore, the device according to the invention can be secured to the top side or bottom walls of the container, if desired. In that case the plate is normally flat. Instead it is possible to secure the device according to the invention to one or more corners of the container. In that case the shape of plate has to be adapted to the shape of the corresponding corner of the container.

The plate should be made of a material having a low coefficient of thermal expansion in order to prevent the development of high stresses in the heat-insulating material of the container. It is preferred to use for this purpose a suitable metal, such as invar. If desired, suitable non-metallic materials may be used instead.

In the embodiment of the invention as described, the means for securing or locating a structure or apparatus to, or relative to, the plate 16 is a cylinder 19. Instead, it is possible to provide the inner side 22 of the plate 16 with notches or slits of suitable shape, lugs, bolts or eyeholes.

Instead of one ply of glass-cloth, the laminate 14 may comprise a plurality of plies of glass-cloth on top of each other.

We claim:

1. A heat-insulated container for liquefied gases, comprising a rigid outer shell internally lined with a heat-insulating rigid polyurethane foam material and provided with a means for locating and supporting structures or apparatus to the inner surface of said container, wherein:

said locating means comprises a plate member formed of a material having a low coefficient of thermal expansion;

said plate member being bonded to the inner side of said heat-insulating material with a cured epoxy resin formulation;

said plate member being provided with means for securing or locating a structure or apparatus thereto; and a laminate collar comprising a fiber material and a cured epoxy resin formulation mounted about the periphery of said plate member, said laminate collar being bonded to said plate member and said heat-insulating material with a cured epoxy resin formulation.

2. The heat-insulated container of claim 1, wherein said plate member is flat.

3. The heat-insulated container of claim 2, wherein said plate member is formed in the shape of a disc.

4. The heat-insulated container of claim 1, wherein said plate member is tapered along its periphery.

5. The heat-insulated container of claim 1, wherein said plate member is made of an iron-nickel alloy having a low coefficient of thermal expansion.

6. The heat-insulated container of claim 5, wherein said plate member is formed of invar.

7. The heat-insulated container of claim 1, wherein said means for securing or locating a structural apparatus to said plate member is an extension of said plate member.

8. The heat-insulated container of claim 7, wherein said extension is formed in the shape of a cylinder having a first end secured to said plate member, and a second end for providing support and locating structures.

9. The heat-insulated container of claim 8, wherein said first end of said cylinder is provided with a radial flange for securing said cylinder to said plate member.

10. The heat-insulated container of claim 1, wherein said plate member is provided with vent holes.

11. The heat-insulated container of claim 1, wherein said epoxy resin formulation includes a reinforcement material.

12. The heat-insulated container of claim 11, wherein said reinforcement material is milled glass fiber.

13. The heat-insulated container of claim 1, wherein a laminate comprising a glass-cloth and a cured epoxy resin formulation is provided on the inner surface of said heat-insulating material.

* * * * *